US009848650B2

(12) United States Patent
Li et al.

(10) Patent No.: US 9,848,650 B2
(45) Date of Patent: Dec. 26, 2017

(54) ATOMIZER AND AEROSOL INHALING DEVICE HAVING SAME

(71) Applicant: Shenzhen First Union Technology Co., Ltd., Shenzhen, Guangdong Province (CN)

(72) Inventors: Yonghai Li, Shenzhen (CN); Zhongli Xu, Shenzhen (CN)

(73) Assignee: SHENZHEN FIRST UNION TECHNOLOGY CO., LTD., Shenzhen, Guangdong Province (CN)

( * ) Notice: Subject to any disclaimer, the term of this patent is extended or adjusted under 35 U.S.C. 154(b) by 122 days.

(21) Appl. No.: 14/880,262

(22) Filed: Oct. 11, 2015

(65) Prior Publication Data

US 2016/0113326 A1 Apr. 28, 2016

(30) Foreign Application Priority Data

Oct. 24, 2014 (CN) ..... 2014 2 0619030 U

(51) Int. Cl.
*A24F 47/00* (2006.01)
*H05B 3/00* (2006.01)

(52) U.S. Cl.
CPC ..... *A24F 47/008* (2013.01); *H05B 3/00* (2013.01)

(58) Field of Classification Search
CPC ..... A24F 47/008
See application file for complete search history.

(56) References Cited

U.S. PATENT DOCUMENTS

2013/0220315 A1* 8/2013 Conley ..... A61M 11/042 128/202.21
2015/0238723 A1* 8/2015 Knudsen ..... A24F 47/002 128/200.21
2015/0272217 A1* 10/2015 Chen ..... A24F 47/008 131/329
2016/0007654 A1* 1/2016 Zhu ..... A24F 47/008 131/328
2016/0095356 A1* 4/2016 Chan ..... A24F 47/008 131/329

FOREIGN PATENT DOCUMENTS

WO WO 2015070402 A1 * 5/2015 ..... A24F 47/008

* cited by examiner

*Primary Examiner* — Eric Yaary
(74) *Attorney, Agent, or Firm* — Cheng-Ju Chiang

(57) ABSTRACT

An exemplary atomizer includes a main body, an atomizing component received in the main body, and a liquid chamber configured for receiving tobacco liquid. The atomizing component is configured for generating aerosol from the tobacco liquid. The atomizing component and the liquid chamber cooperatively define a liquid passage therebetween. The atomizer further includes a liquid blocking element defining a notch. The liquid blocking element is capable of rotating relative to the main body between a first position where the liquid blocking element prevents the tobacco liquid in the liquid chamber from flowing into the liquid passage, and a second position where the notch is in alignment with the liquid passage, so that the tobacco liquid flows to the atomizing component via the liquid passage.

11 Claims, 6 Drawing Sheets

ATOMIZER AND AEROSOL INHALING DEVICE HAVING SAME

TECHNICAL FIELD

The present invention relates to aerosol inhaling devices, and particularly to an atomizer and an aerosol inhaling device using same.

BACKGROUND ART

Typically, an atomizer for an electronic cigarette includes a liquid chamber configured for storing tobacco liquid, a glass fiber core for absorbing tobacco liquid from the tobacco liquid, and a heating component configured for heating the tobacco liquid in the glass fiber core to form aerosol. The aerosol is expelled via an air passage. When the atomizer is not used, the tobacco liquid still permeates the glass fiber core, and the tobacco liquid may drop from the glass fiber core and leak due to gravity or a shake.

What are needed, therefore, are an atomizer and an aerosol inhaling device using same, which can overcome the above shortcomings.

SUMMARY

An exemplary atomizer includes a main body, an atomizing component received in the main body, and a liquid chamber configured for receiving tobacco liquid. The atomizing component is configured for generating aerosol from the tobacco liquid. The atomizing component and the liquid chamber cooperatively define a liquid passage therebetween. The atomizer further includes a liquid blocking element defining a notch. The liquid blocking element is capable of rotating relative to the main body between a first position where the liquid blocking element prevents the tobacco liquid in the liquid chamber from flowing into the liquid passage, and a second position where the notch is in alignment with the liquid passage, so that the tobacco liquid flows to the atomizing component via the liquid passage.

BRIEF DESCRIPTION OF THE DRAWINGS

Many aspects of the present disclosure can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Figure 1:
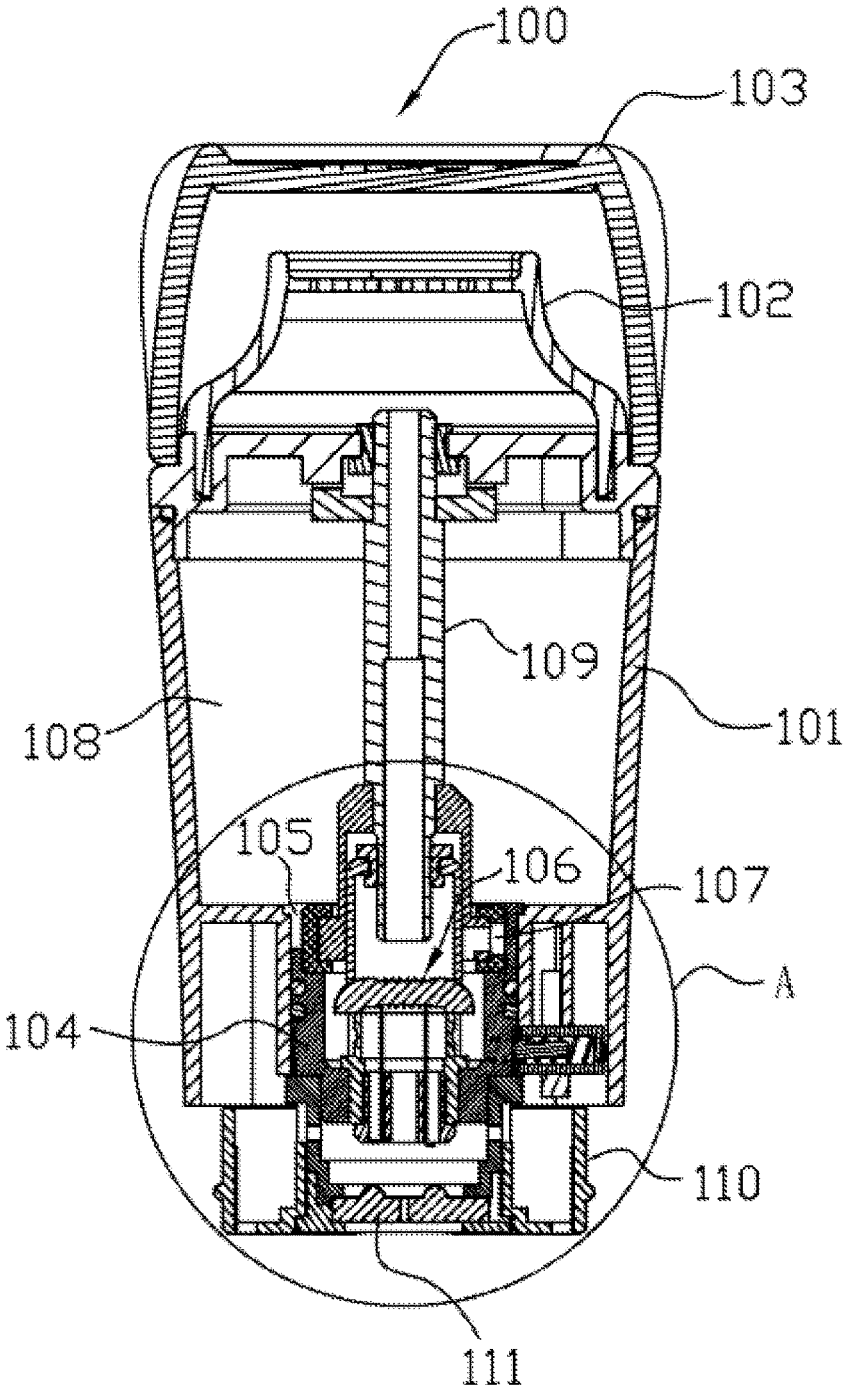
FIG. 1 is a cross-sectional view of an atomizer according to an exemplary embodiment including a liquid blocking element and a liquid passage, when the liquid passage is closed.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Several definitions that apply throughout this disclosure will now be presented.

The term "outside" refers to a region that is beyond the outermost confines of a physical object. The term "inside" indicates that at least a portion of a region is partially contained within a boundary formed by the object. The term "substantially" is defined to be essentially conforming to the particular dimension, shape or other word that substantially modifies, such that the component need not be exact. For example, substantially cylindrical means that the object resembles a cylinder, but can have one or more deviations from a true cylinder. The term "comprising," when utilized, means "including, but not necessarily limited to"; it specifically indicates open-ended inclusion or membership in the so-described combination, group, series and the like.

Referring to FIG. 1, an atomizer 100 includes a main body 101, an atomizing component 106 in the main body 101, and a liquid chamber 108 defined in the main body 101. The liquid chamber 108 is configured (i.e., structured and arranged) for storing tobacco liquid. The atomizing component 106 is configured for heating the tobacco liquid in the liquid chamber 108 to form aerosol. A mouthpiece 102 is provided at an end of the main body 101. A cover 103 is further provided to shield the mouthpiece 102 from dust. The atomizer 100 further includes a liquid blocking element 104 rotatable relative to the main body 101. The liquid blocking element 104 includes a notch 105. A liquid passage 107 is positioned between the atomizing component 106 and the liquid chamber 108. When the liquid blocking element 104 is in a first position, the liquid blocking element 104 prevents the tobacco liquid from entering the liquid passage 107, and the liquid passage 107 is closed. When the atomizer 100 is not used, the liquid blocking element 104 is kept in this position, avoiding liquid leakage. When a user of the atomizer 100 smokes, the liquid blocking element 104 is rotated a predetermined angle, so that the notch 105 aligns with the liquid passage 107. In this second position, the liquid passage 107 is opened, the tobacco liquid flows to the atomizing component 106 via the liquid passage 107.

The atomizer further includes an air pipe assembly 109 for expelling aerosol generated by the atomizing component 106. The liquid chamber 108 surrounds the air pipe assembly 109. The air pipe assembly 109 is substantially arranged along a central axis of the main body 101, and two ends of the air pipe assembly 109 are hermetically coupled to the main body 101 by a fixing holder thereof and to the mouthpiece 102, respectively. The air pipe assembly 109 and an inner surface of the main body 101 cooperatively define an annular space serving as the liquid chamber 108. A first end of the air pipe assembly 109 is connected with an atomizing cavity, and a second end of the air pipe assembly 109 is connected with the mouthpiece 102. The atomizer 100 further includes a holder 110 at a bottom end thereof for connecting with an external power supply. The liquid blocking element 104 is fixed engaged with the holder 110, and the holder 110 is rotatable relative to the main body 101. An electrode holder 111 is arranged in the holder 110, and two electrodes 123 (See FIG. 5) are fixed in the electrode holder 111. After the holder 110 is coupled to the power supply, the holder 110 is fixed relative to the power supply. Accordingly, the liquid blocking element 104 is rotated to open or close the liquid passage 107 by rotating the power supply (described in detail later).

Figure 2:
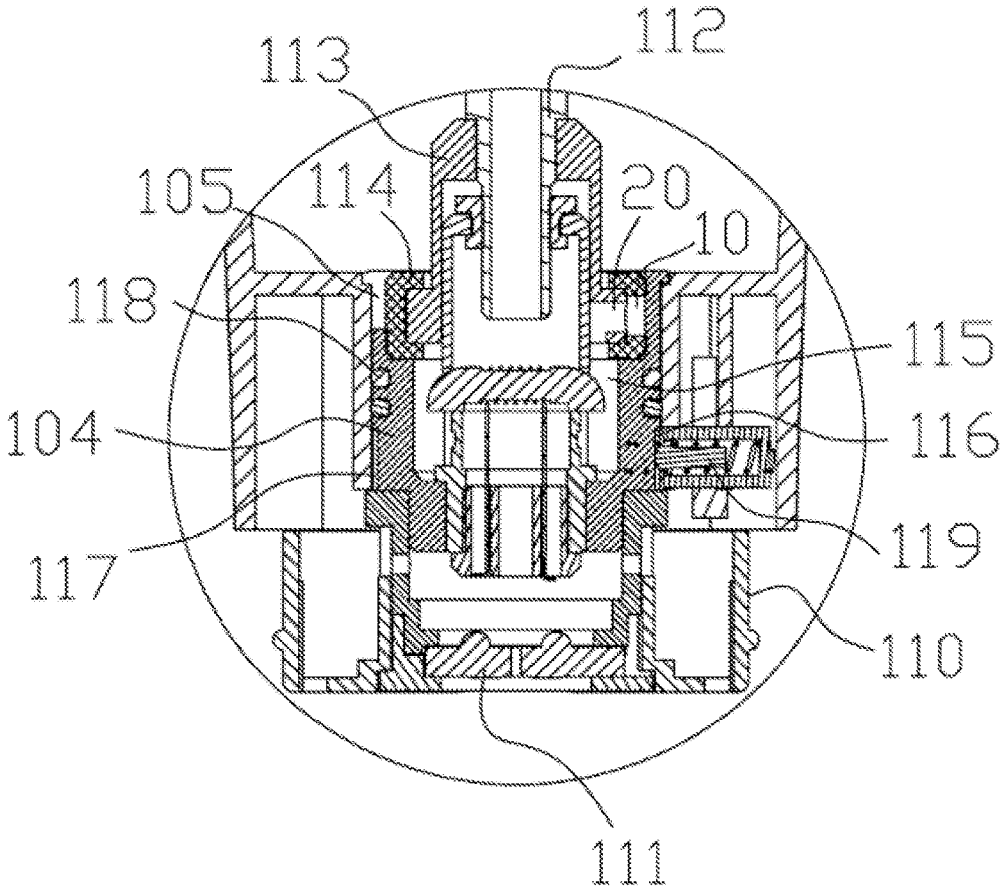
FIG. 2 is an enlarged view of area A of FIG. 1.
Figure 3:
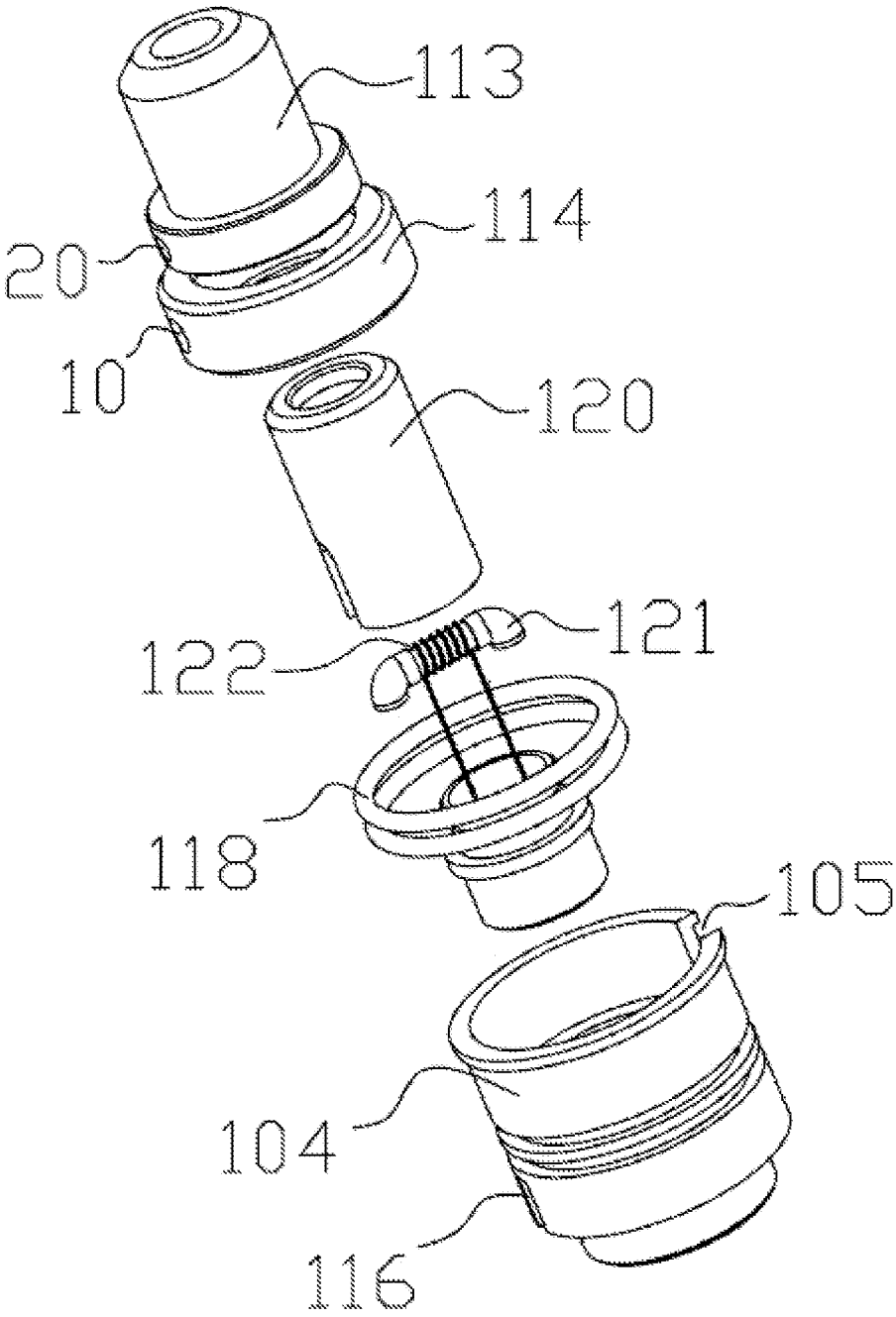
FIG. 3 is an exploded perspective view of the liquid blocking element and components forming the liquid passage.

Also referring to FIGS. 2-3, as a preferred embodiment, the atomizing component 106 includes a heating element and a liquid conducting element 121 in contact with the heating element. The liquid conducting element 121 is porous, and absorbs tobacco liquid via capillary action. The liquid conducting element 121 may be made of glass fiber core. The heating element may be a heating wire 122. The heating wire 122 is evenly wound around the liquid conducting element 121. The liquid conducting element 121 is configured for absorbing tobacco liquid.

Further, the main body 101 defines a buffer chamber 115 in communication with the liquid passage 107. The buffer chamber 115 can store an amount of tobacco liquid. When the liquid passage 107 is opened by the liquid blocking element 104, the tobacco liquid in the liquid chamber 108 flows into the buffer chamber 115. Two opposite ends of the liquid conducting element 121 insert into the buffer chamber 115 to absorb tobacco liquid.

In the present embodiment, the liquid blocking element 104 is substantially cylindrical. The liquid blocking element 104 is arranged between the air pipe assembly 109 and the main body 101. The atomizing element 106 is positioned in the liquid blocking element 104. The air pipe assembly 109 includes an air pipe 112 and a fixing holder 113 arranged at a bottom end of the air pipe 112. A ring-shaped silica holder 114 is arranged between the liquid blocking element 104 and the fixing holder 113. A sealing ring 118 is arranged between the liquid blocking element 104 and the main body 101. The silica holder 114 defines a first liquid hole 10. The fixing holder 113 defines a second liquid hole 20 in a sidewall. The silica holder 114 tightly nests the fixing holder 113, and is fixed relative to the fixing holder 113. The first liquid hole 10 and the second liquid hole 20 are in alignment to form the liquid passage 107.

The liquid conducting element 121 is supported by a bracket 120. The bracket 120 is cylindrical, and allows air to pass through. The bracket 120 and the liquid conducting element 121 are both positioned in the liquid blocking element 104. The bracket 120 and the liquid blocking element 104 cooperatively define the buffer chamber 115. A large part of the liquid conducting element 121 is positioned in the bracket 120, and two opposite ends of the liquid conducting element 121 insert into the buffer chamber 115. The notch 105 is substantially in alignment with the liquid passage 107 in a horizontal direction. When the liquid blocking element 104 is rotated, the main body 101, the fixing holder 113, the silica holder 114 and the atomizing component 106 are fixed. The notch 105 is selectively in alignment with the liquid passage 107, and the liquid passage 107 is thus selectively opened or closed.

To adjust the liquid blocking element 104 conveniently, the liquid blocking element 104 defines a first groove 116 and a second groove 117 in an outer surface. The first groove 116 and the second groove 117 cooperatively form a predetermined arc angle. The main body 101 includes an elastic pin 119 for engaging into the first groove 116 or the second groove 117. The elastic pin 119 includes a pin and a spring connected to a first end of the pin. An opposite second end of the pin is arc-shaped in cross-section, and is engaged in the first groove 116 or the second groove 117. When the liquid blocking element 104 is rotated, the elastic pin 119 is shifted between the first groove 116 and the second groove 117, so that the user can check if the liquid blocking element 104 opens or closes the liquid passage 107. In a vertical direction, the elastic pin 119 is positioned right below the liquid passage, and the second groove 117 is arranged right below the notch 105. Accordingly, only when the elastic pin 119 engages in the second groove 117, the notch 105 communicates with the liquid passage 107. When the elastic pin engages into the first groove 116, the notch 105 and the liquid passage 107 are misaligned, and the liquid passage 107 is closed. Quite usefully, an arc angle formed between the first groove 116 or the second groove 117 is 180 degrees. Therefore, the liquid conducting element 104 is rotated 180 degrees from a position where the liquid passage 107 is open to a position where the liquid passage 107 is closed.

Figure 4:
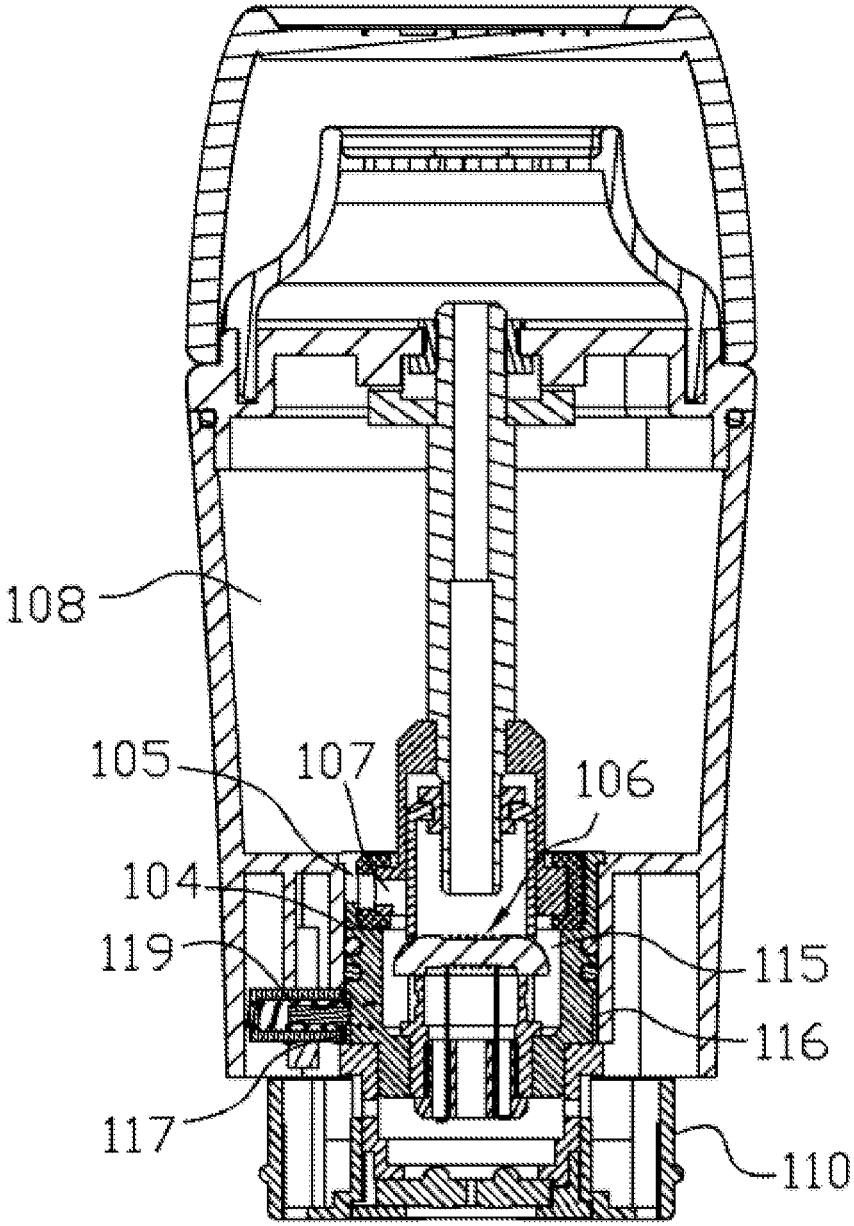
FIG. 4 is a cross-sectional view of an atomizer according to an exemplary embodiment, when the liquid passage is opened.

Referring to FIG. 4, the liquid passage 107 is open. In this state, the main body 101 is rotated 180 degrees relative to the liquid blocking element 104 and the holder 110. The elastic pin 119 is shifted from the first groove 116 to the second groove 117. The liquid passage 107 is rotated to align with the notch 105, so that the tobacco liquid in the liquid chamber 108 flows to the liquid passage 107.

Figure 5:
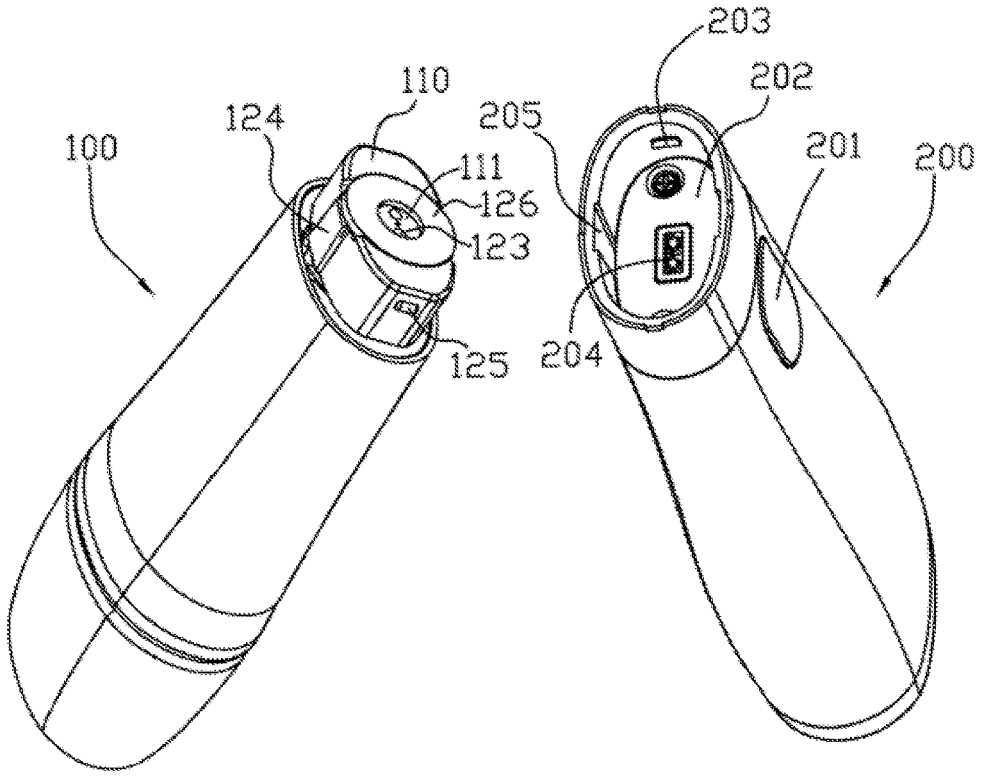
FIG. 5 is a perspective view of an aerosol inhaling device including the atomizer of FIG. 1 and a power supply when unassembled.

Referring to FIG. 5, an aerosol inhaling device includes an atomizer 100 and a power supply 200 coupled with the atomizer 100. The atomizer 100 and the power supply 200 are connected by a plug-type connection. The power supply 200 includes a recessed portion at an end, and the holder 110 is engaged in the recessed portion. The electrode holder 111 includes two electrodes 123, which are connected to two opposite ends of the heating wire 122. Two electrodes 204 are arranged in the recessed portion. The electrodes 204, usually in the form of elastic pins, are configured for contacting with the electrodes 123. The power supply 200 further includes a switch 201 for turning on/off the atomizer 100.

To ensure that the holder 110 is rotated together with the power supply 200 after engagement, a protruding block 124 is provided on a sidewall of the holder 110, and the recessed portion defines a groove 205 matching with the protruding block 124. After the holder 110 is inserted into the recessed portion, the protruding block 124 is engaged in groove 205, avoiding a rotation between the holder 110 and the power supply 200. The atomizer 100 and the power supply 200 may be coupled by means of interference fit. In the present embodiment, the atomizer 100 and the power supply 200 are engaged by a magnetic connection. In detail, the power supply 200 includes a permanent magnet 202 in the recessed portion, the holder 110 includes an iron piece 126, and the atomizer 100 and the power supply 200 are coupled due to a magnetic force between the permanent magnet 202 and the iron piece 126. To strengthen an axial connection between the atomizer 100 and the power supply 200, the holder 110 further includes a protrusion 125 on the sidewall, and correspondingly, the recessed portion of the power supply 200 further includes a recess 203. When the atomizer 100 is engaged with the power supply 200, the protrusion 125 is coupled with the recess 203.

Figure 6:
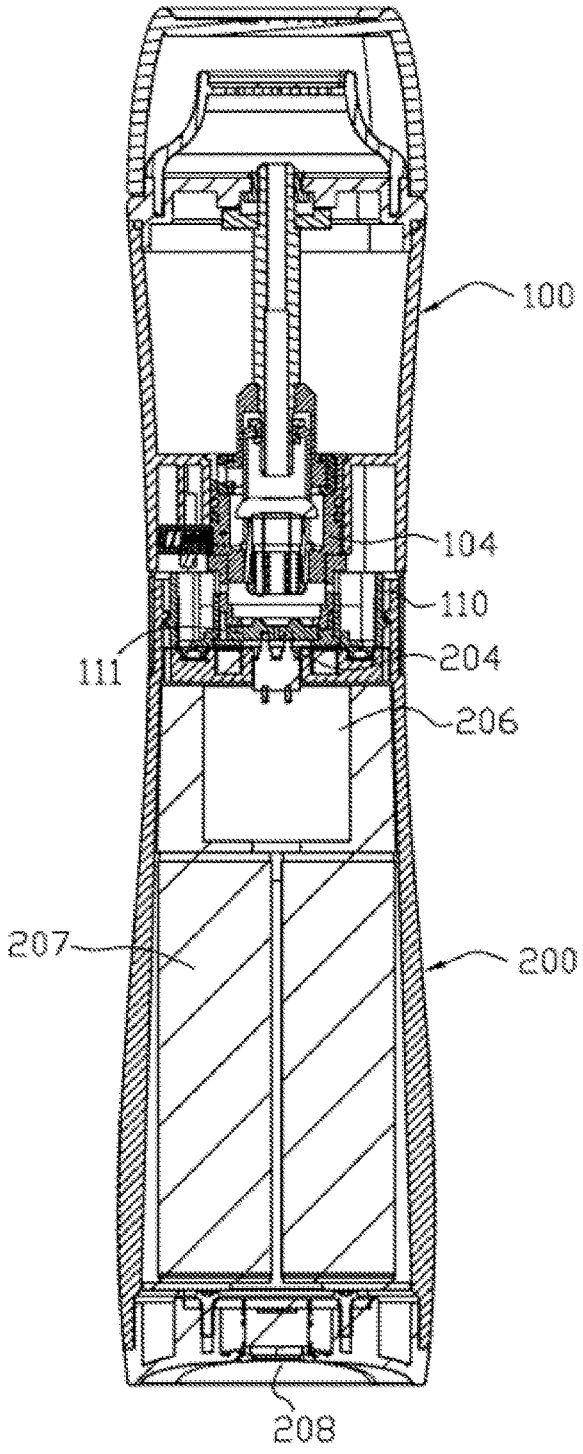
FIG. 6 is a cross-sectional view of the aerosol inhaling device of FIG. 5.

Also referring to FIG. 6, the power supply 200 includes two lion batteries 207 and a charge interface 208 at one end. The batteries 207 outputs a voltage via a circuit board 206. The electrodes 204 are electrically connected with the circuit board 206. After the atomizer 100 is coupled with the power supply 200, the electrodes 204 are in contact with the electrodes 123 in the electrode holder 111. When the user smokes, the power supply 200 is rotated, and then the power supply 200 drives the holder 110 and the liquid blocking element 104 to rotate between the first position and the second position.

It is understood that the above-described embodiments are intended to illustrate rather than limit the disclosure. Variations may be made to the embodiments and methods without departing from the spirit of the disclosure. Accordingly, it is appropriate that the appended claims be construed broadly and in a manner consistent with the scope of the disclosure.

What is claimed is:

1. An atomizer, comprising:

a main body;

an atomizing component received in the main body and comprising a liquid conducting element;

a liquid chamber configured for receiving tobacco liquid, the atomizing component being configured for generating aerosol from the tobacco liquid; and a holder configured for connecting with an external power supply, wherein the liquid conducting element is fixedly connected with the holder, and the holder is rotatable relative to the main body;

wherein the atomizing component and the liquid chamber cooperatively defining a liquid passage therebetween; the atomizer further comprises a liquid blocking element defining a notch, the liquid blocking element is capable of rotating relative to the main body between a first position where the liquid blocking element prevents the tobacco liquid in the liquid chamber from flowing into the liquid passage, and a second position where the notch is in alignment with the liquid passage, so that the tobacco liquid flows to the atomizing component via the liquid passage.

2. The atomizer according to claim 1, wherein the atomizing component comprises a heating element and the liquid conducting element is in contact with the heating element, the liquid conducting element is configured for absorbing the tobacco liquid, and the heating element is configured for heating the tobacco liquid in the liquid conducting element.

3. The atomizer according to claim 2, wherein the main body defines a buffer chamber communicating with the liquid passage, and ends of the liquid conducting element insert into the buffer chamber.

4. The atomizer according to claim 1, further comprising an air pipe assembly configured for expelling aerosol generated by the atomizing component, wherein the liquid chamber surrounds the air pipe assembly.

5. The atomizer according to claim 4, wherein the liquid blocking element is substantially cylindrical, and is positioned between a bottom end of the air pipe assembly and the main body, and the atomizing component is arranged in the liquid blocking element.

6. The atomizer according to claim 1, wherein the liquid blocking element defines a first groove and a second groove in an outer surface, the first and the second grooves cooperatively form a predetermined arc angle; the main body comprises an elastic pin matching with the first and the second grooves, when the liquid blocking element is rotated, the elastic pin is selectively engaged in the first or the second grooves.

7. The atomizer according to claim 6, wherein an arc angle formed between the first and the second grooves is 180 degrees.

8. An aerosol inhaling device, comprising:

an atomizer according to claim 1; and a power supply configured for supplying the atomizer power.

9. The aerosol inhaling device according to claim 8, wherein the power supply is also configured for driving the liquid blocking element to rotate when rotated.

10. The aerosol inhaling device according to claim 8, wherein the atomizer and the power supply are coupled by a magnetic connection.

11. An atomizer, comprising:

a main body;

an atomizing component received in the main body; and a liquid chamber configured for receiving tobacco liquid, the atomizing component being configured for generating aerosol from the tobacco liquid;

wherein the atomizing component and the liquid chamber cooperatively defining a liquid passage therebetween; the atomizer further comprises a liquid blocking element defining a notch, the liquid blocking element is capable of rotating relative to the main body between a first position where the liquid blocking element prevents the tobacco liquid in the liquid chamber from flowing into the liquid passage, and a second position where the notch is in alignment with the liquid passage, so that the tobacco liquid flows to the atomizing component via the liquid passage; and wherein the liquid blocking element defines a first groove and a second groove in an outer surface, the first and the second grooves cooperatively form a predetermined arc angle; the main body comprises an elastic pin matching with the first and the second grooves, when the liquid blocking element is rotated, the elastic pin is selectively engaged in the first or the second grooves.

* * * * *